US006237744B1

(12) United States Patent
Reist

(10) Patent No.: US 6,237,744 B1
(45) Date of Patent: May 29, 2001

(54) APPARATUS FOR SUPPLYING PRINTED PRODUCTS TO A DISCHARGE LOCATION

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/229,180

(22) PCT Filed: May 22, 1997

(86) PCT No.: PCT/CH97/00201

§ 371 Date: Jan. 13, 1999

§ 102(e) Date: Jan. 13, 1999

(87) PCT Pub. No.: WO98/03421

PCT Pub. Date: Jan. 29, 1998

(30) Foreign Application Priority Data

Jul. 19, 1996 (CH) ..... 1817/96

(51) Int. Cl.[7] ..... B65G 37/00
(52) U.S. Cl. ..... 198/465.4; 271/204
(58) Field of Search ..... 198/465.4, 867.02; 271/204, 151, 295

(56) References Cited

U.S. PATENT DOCUMENTS

| | | | | |
|---|---|---|---|---|
| 3,032,341 | | 3/1962 | Reist | 271/79 |
| 3,123,888 | | 3/1964 | Meyers | 28/1 |
| 4,007,824 | * | 2/1977 | Reist | 198/462 |
| 4,039,182 | | 8/1977 | Reist et al. | 271/64 |
| 4,438,618 | * | 3/1984 | Honegger | 53/430 |
| 4,866,910 | | 9/1989 | Reist | 53/430 |
| 4,887,809 | | 12/1989 | Eberle | 271/203 |
| 5,007,624 | | 4/1991 | Chandhoke | 270/52 |
| 5,503,264 | | 4/1996 | Eberle | 198/803.01 |

* cited by examiner

*Primary Examiner*—Christopher P. Ellis
*Assistant Examiner*—Rashmi Sharma
(74) *Attorney, Agent, or Firm*—Brinks Hofer Gilson & Lione

(57) ABSTRACT

At a delivery station (1), printed products (4) are unwound from a product reel (6) and transferred to a transfer area (11) of a conveying system (12). The latter has transport members (13) provided with controllable grippers (15) moved by conveying means (19, 19*a*) or by the force of gravity along a path of transport (14) designed as a closed loop. The printed products (4) are transferred at a delivery area (21) to a further processing device, for example an insetting or collecting drum (28). A buffer section (23), along which the transport members (13) are stored by reducing their mutual distance, is arranged upstream of said dispensing area (21). While an empty winding core (8) is exchanged for a full product reel (6), the supply of printed products (4) to the transfer area (11) is interrupted. During that time, the transport members (13) carrying printed products (4) are taken from the buffer section (23), ensuring a continuous supply of printed products (4) to the delivery station (21).

12 Claims, 2 Drawing Sheets

APPARATUS FOR SUPPLYING PRINTED PRODUCTS TO A DISCHARGE LOCATION

Figure 1:
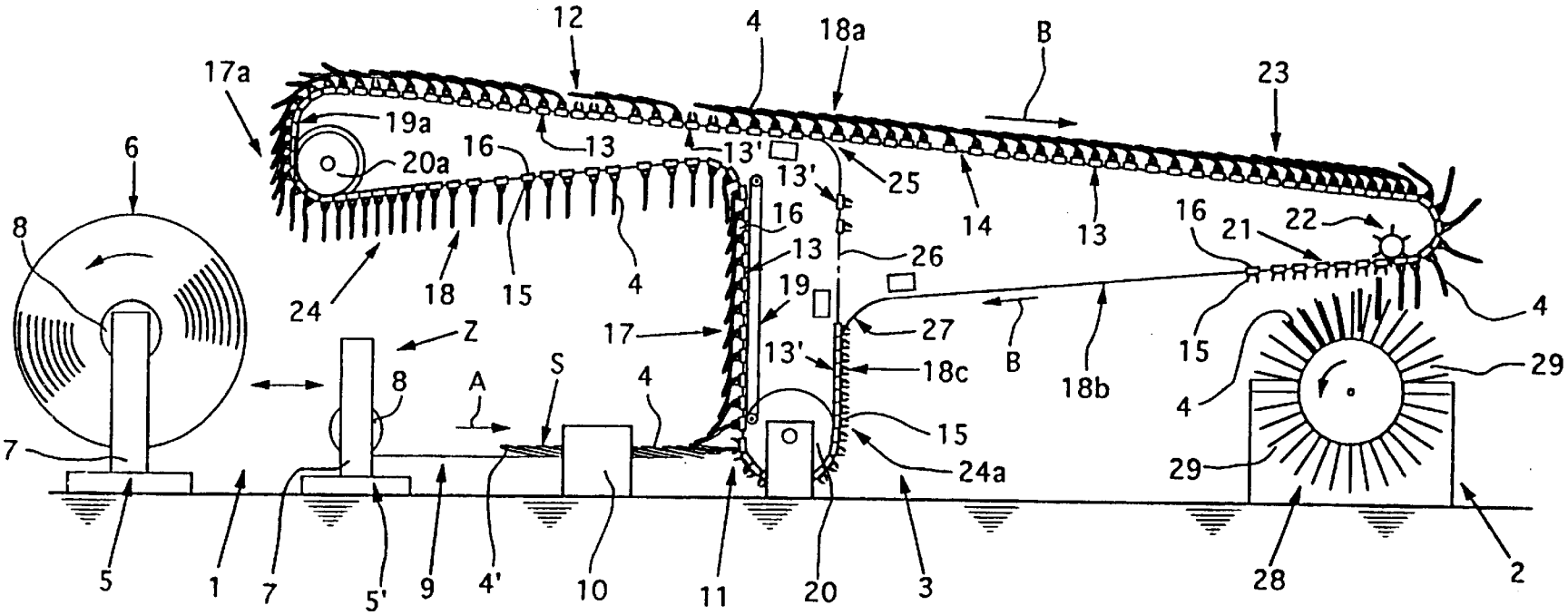

The present invention relates to an apparatus for supplying printed products, such as newspapers, periodicals, brochures and the like, as well as supplements for such printed products, to a discharge location according to the preamble of claim 1.

DE-A-31 23 888 (and the corresponding U.S. Pat. No. 4,438,618) discloses an apparatus of this type in which the source for the printed products is a product roll arranged in an unwinding location. A specific number of printed products are stored in this roll, on a winding core, and are removed from the roll, and led away, by being unwound from the same. As soon as all the printed products have been unwound from the roll, the empty winding core has to be removed from the unwinding location and replaced by a new, full roll. While an empty winding core is being exchanged for a new roll, the operation in which printed products are led away is interrupted. This disadvantage may indeed be overcome by doubling the number of unwinding locations, of which in each case one is in operation while the other is being charged with a new roll. However, such a solution requires considerable mechanical outlay.

The object of the present invention, then, is to provide an apparatus of the type mentioned in the introduction which makes it possible, despite the limited delivery capacity of the source, to feed printed products continuously to a downstream discharge location.

This object is achieved according to the invention by an apparatus having the features of claim 1.

The buffer-storage section of the conveying arrangement conveying the printed products from the source to the discharge location provides a temporary store for the transporting elements which are transporting these printed products. These transporting elements are then fed out of said buffer-storage path to the discharge location. After the source has been used up and is either exchanged for a new source or filled up again with new printed products, the operation of continuous feeding of printed products to the discharge location out of the buffer-storage path can be continued during this time, in which case the buffer-storage path is reduced in length because, during the operation of exchanging or refilling the source, there are no new transporting elements loaded with printed products passing to the buffer-storage path.

Preferred developments of the apparatus according to the invention form the subject matter of the dependent claims.

Figure 2:
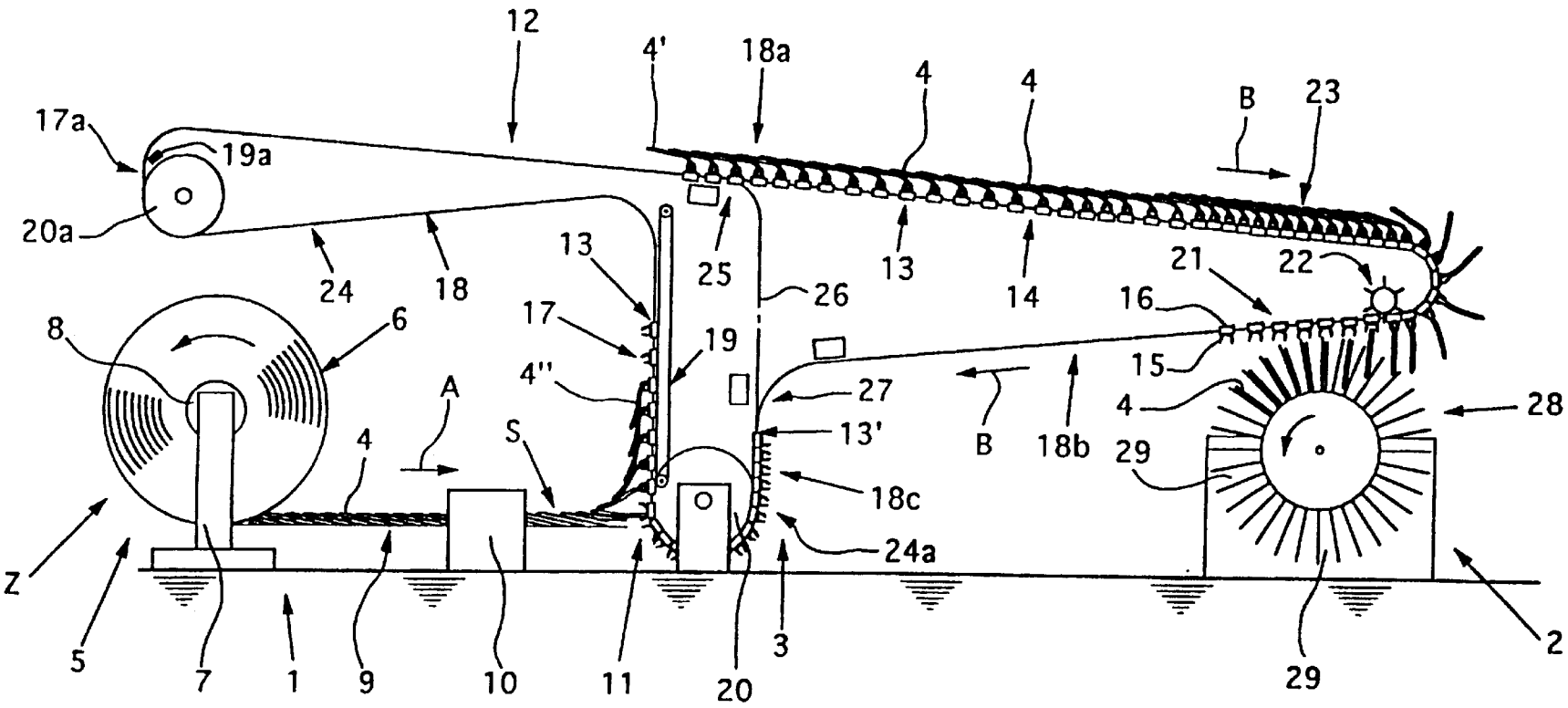

An exemplary embodiment of the subject matter of the invention is explained in more detail hereinbelow with reference to the drawing, in which, purely schematically:

FIG. 1 shows an apparatus for supplying printed products from a product roll to a discharge location at the point in time when a product roll is being exchanged, and FIG. 2 shows the apparatus according to FIG. 1 shortly after a full product roll has been put into operation.

The apparatus shown in FIGS. 1 and 2 has a delivery station 1 and a processing station 2, which are connected to one another via a conveying arrangement 3. This conveying arrangement 3 transports, in a manner which will be described in more detail, printed products 4, namely newspapers, periodicals, brochures and the like, as well as supplements for such printed products, which are delivered from a source Z located in the delivery station 1. In the present exemplary embodiment, the source Z is an exchangeable storage unit 5 or 5', which is formed from a product roll 6 mounted in a framework 7, which can be displaced by means of a suitable transporting unit. The product roll 6 comprises printed products which, in a known manner, are wound up onto a winding core 8 in an imbricated formation. The winding core 8 is mounted rotatably in the framework 7.

FIG. 1 shows the state at the point in time when an empty storage unit 5' is being exchanged for one with a full roll 6, while FIG. 2 illustrates the state shortly after a new storage unit 5 with a full roll 6 has been put into operation.

The printed products 4 unwound from the roll 6 are received by a conveyor 9, preferably a belt conveyor, and conveyed through an evening-out device 10 to a transfer location 11 in the direction of the arrow A, in an imbricated formation S. The evening-out device 10 ensures, in a manner known per se, that the spacing between successive printed products 4 in the imbricated formation S is always approximately the same and that there are no gaps in the imbricated formation. At the transfer location 11, the printed products 4 are transferred to a conveying system, which is designated in general terms by 12.

The conveying system 12 has a number of individual transporting elements 13, which are independent of one another and are moved in the direction of the arrow B along a conveying path 14 designed as a closed loop. The transporting elements 13 are separate from one another, i.e. are not coupled to one another and are independent of one another. The spacing between the transporting elements 13 can thus vary. The transporting elements 13 have controllable grippers 15, which are fastened on carriages or slides 16. At the transfer location 11, the gripper 15 of in each case one transporting element 13 grasps a printed product 4 at its leading edge. The conveying path 14 [sic] has upwardly sloping sections 17, 17*a* and downwardly sloping sections 18, 18*a*, 18*b* and 18*c* which which alternate with one another. The transporting elements 13 are moved along the downwardly sloping sections 18–18*c* under the action of gravitational force. If appropriate, it is also possible for suitable conveying means to be provided. In order to move the transporting elements 13 along the upwardly sloping sections 17 and 17*a*, conveying means 19 are provided, or it is possible for corresponding conveying means 19*a* to be provided, these not being illustrated specifically in FIGS. 1 and 2. In order to transfer the transporting elements 13 from a downwardly sloping section 18 or 18*c* into an upwardly sloping section 17*a* or 17, respectively, deflection wheels 20*a* and 20 are respectively provided, these likewise having a conveying action. This conveying action may be sufficient in the case of short upwardly sloping sections.

The processing station 2 is assigned a discharge location 21, at which the printed products 4 are released by the grippers 15 of the transporting elements 13. Arranged upstream of this discharge location 21 is a timing device 22 (only illustrated schematically) which ensures that the transporting elements 13 pass to the discharge location 21 in a specific timed sequence, in order to ensure satisfactory transfer of the printed products 4 to the devices of the processing station 2. That section of the conveying path 14 which is arranged upstream of the timing device 22 is designed as a buffer-storage section 23, along which the transporting elements 13 are stored before they are retrieved by means of the timing device 22. The transporting elements 13 assume heir smallest possible spacing from one another in his buffer-storage section 23.

The sections 18*c* and 18 of the conveying path 12 which are arranged upstream of the deflection wheels 20, 22*a*, respectively, serve as accummulation or storage sections 24, 24*a* in which the transporting elements 13 can likewise be stored. Since the empty transporting elements 13' are stored in the accummulation or storage section 24*a*, it is ensured that a transporting element 13' is available for each printed product 4 which passes to the transfer location 11.

Arranged upstream of the buffer-storage section 23, in the downwardly sloping section 18*a*, is a branching location 25 with a diverter (not illustrated specifically). From this branching location 25, a branch conveying path 26 leads to an introduction location 27, which likewise has a diverter (not illustrated) and is arranged downstream of the discharge location 21. Empty transporting elements 13', that is to say those which are not transporting any printed products 4, can be ejected out of the conveying path 12 at the branching location 25. The empty transporting elements 13' ejected are moved along the branch conveying path 26 to the introduction location 27, at which they can be introduced into the conveying path 14 again by means of the diverter. This means that the empty transporting elements 13' which are ejected at the branching location 25 are combined again, at the introduction location 27, with the empty transporting elements 13' which, at the discharge location 21, have discharged the printed products 4 conveyed by them. In order to switch over the diverters of the branching location 25 and of the introduction location 27, it may be necessary for the operation of transporting elements 13, 13' running up to the branching location 25 and to the introduction location 27 to be interrupted temporarily by suitable restraining means (not illustrated specifically).

Located in the processing station 2 is an insertion drum 28 (only illustrated schematically) which is of known design and is driven in rotation in a counterclockwise direction. The insertion drum 28 has radially running receiving compartments 29 into which the printed products 4 released at the discharge location 21 drop. In the present case, the printed products 4 transported by the transporting elements 13 are folded printed sheets which are retained by the grippers 15 of the transporting elements 13 at their open side edge, which is located opposite the folded edge. It goes without saying that it is also possible for the printed products 4 to be collated rather than inserted in the insertion drum 28.

Of course, it is also possible for other devices for further processing the printed products 4 fed to be arranged at the processing station 2, e.g. other insertion and collation devices as processing drums or else collecting devices for collecting the printed sheets 4, such as collecting drums or collecting paths. Furthermore, it is also conceivable for the printed products 4 to be formed into stacks in the processing station 2.

As can be gathered from the preceding description, the loaded transporting elements 13, which are moved from the transfer location 11 to the discharge location 21 in the direction of the arrow B by conveying means or under the action of gravitational force, are stored temporarily along the buffer-storage section 23, but also along the accummulation or storage section 24, in which case the spacing between the transporting elements is reduced. This buffer storage of the transporting elements 13 makes it possible, even if the feeding of printed products 4 to the transfer location 11 is interrupted, for the operation of feeding printed products 4 to the discharge location 21 to go on continuously, to be precise primarily from the buffer-storage section 23. In this case, the length of said buffer-storage section 23 decreases temporarily. The reason for an interruption in the delivery of printed products 4 to the transfer location 11 is that the source Z has a limited delivery capacity, i.e. only a limited number of printed products 4 is stored in the product roll 6.

FIG. 1 shows that the storage unit 5' has been relieved of load, i.e. that the winding core 8 is empty. The last printed product unwound from the winding core 8 is designated by 4'. It is then necessary for the empty storage unit 5' to be exchanged for a new storage unit 5 with a full product roll 6, as is indicated in FIG. 1. During this time, the conveying system 12 continues running, in order that printed products 4 continue to be fed to the discharge location 21.

As soon as the new storage unit 5 is ready for delivery, the printed products 4 are unwound from the new product roll 6, and fed to the transfer location 11, in imbricated formation, as can be seen from FIG. 2. The first printed product unwound from the new product roll 6 is designated in FIG. 2 by 4". A gap forms between this printed product 4" and the last printed product 4' unwound from the preceding product roll, as can be seen in FIG. 2. During the interruption in delivery of printed products 4 to the transfer location 11, the buffer-storage section 23 is, as has already been mentioned, reduced, i.e. its length decreases. However, as soon as the product source Z delivers printed products 4 again, the buffer-storage section 23 is filled up again since the delivery speed of the source Z is greater than the speed at which transporting elements 13 are fed to the discharge location 21.

In the new product roll 6 introduced into the delivery station 1 in each case, it is possible to store the same printed products as in the product roll which was unwound beforehand or else different types of printed products as well.

Instead of the storage units 5, 5' with product rolls 6, it is also possible to use other sources Z of limited delivery capacity, e.g. stacks which, once reduced, have to be refilled again.

The transporting elements 13, which are merely illustrated purely schematically in FIGS. 1 and 2, may be of any suitable design. It is also possible for the conveying path 14 of the conveying system 12 to be designed such that the printed products 4 are transported in a hanging position throughout.

The conveying system 12 may, in general, be of any other suitable design. The only important factor is for the spacing between the transporting elements 13 moved along the conveying path 14 of the conveying system 12 to be variable. Instead of a conveying system 12 with transporting elements 13 which, as have been described, are not coupled to one another, it is also possible to use conveying systems in which the transporting elements are connected to one another such that the spacing between the transporting elements can be varied within certain limits, as is known, for example, from EP-A-0 309 702 (and the corresponding U.S. Pat. No. 4,887,809) and EP-A-0 633-212 (and the corresponding U.S. Pat. No. 5,503,264).

What is claimed is:

1. An apparatus for supplying printed products, such as newspapers, periodicals, brochures and the like, as well as supplements for such printed products, to a discharge location (21), having a source (Z) of given, limited storage capacity and having a conveying arrangement (3) which leads away the printed products (4) delivered from the source (Z), wherein the conveying arrangement (3) has a number of individual transporting elements (13), which are moved along a conveying path (14), are intended for transporting the printed products (4) to at least one discharge location (21) and have a variable spacing between them, and wherein the conveying path (14) has a buffer-storage section (23) which is arranged upstream of the discharge location (21), along which the transporting elements (13) are stored temporarily, in which case the spacing between them is reduced, and out of which the transporting elements (13) are moved continuously to the discharge location (21), said conveying path including a branch path for diverting and storing transporting elements (13') that are not transporting printed product from a branch location upstream of said buffer-storage section (23) and reintroducing them into the conveying path at an introduction location (27) downstream of said discharge location (21).

2. The apparatus as claimed in claim 1, wherein the conveying path (14) is designed as a closed loop.

3. The apparatus as claimed in claim 1 or 2, wherein the transporting elements (13) can be moved independently of one another along the conveying path (14).

4. The apparatus as claimed in claim 1, wherein the transporting elements (13) have controllable grippers (15) for retaining the printed products (4).

5. The apparatus as claimed in claim 1, which comprises a conveyor (9) which receives the printed products (4) delivered from the source (Z) and supplies the printed products (4) to a transfer location (11) at which the printed products (4) are received by the transporting elements (13).

6. The apparatus as claimed in claim 1, wherein the source (Z) is formed by a product roll (6), in which the printed products (4) are stored.

7. The apparatus as claimed in claim 6, wherein the product roll (6) is mounted rotatably in a displaceable framework (7).

8. The apparatus as claimed in claim 1, wherein the discharge location (21) is assigned a processing station (2) at which the printed products (4) discharged from the transporting elements (13) are processed.

9. The apparatus as claimed in claim 1, wherein the discharge location (21) is assigned a timing device (22) which causes the transporting elements (13) to be fed out of the buffer-storage section (23) to the discharge location (21) in a specific timed sequence.

10. The apparatus as claimed in claim 1, wherein the conveying path (14) has downwardly sloping sections (**18–18*c*) along which the transporting elements (13**) are moved preferably under the action of gravitational force.

11. The apparatus as claimed in claim 1, wherein the conveying path (14) has upwardly sloping sections (**17, 17*a*) along which the transporting elements (13) are moved by conveying means (19, 19*a***).

12. The apparatus as claimed in claim 1, wherein the conveying path (14) has downwardly sloping sections (**18–18*c*) along which the transporting elements (23) are moved preferably under the action of gravitational force and upwardly sloping sections (17, 17*a*), along which the transporting elements (13) are moved by conveying means (19, 19*a*), and wherein a storage path (24, 24*a*) along which the transporting elements (13) are stored is provided in the transition from a downwardly sloping section (18–18*c*) to an adjoining upwardly sloping section (17, 17*a***).

* * * * *